US008430089B2

(12) United States Patent
Kim et al.

(10) Patent No.: US 8,430,089 B2
(45) Date of Patent: Apr. 30, 2013

(54) HEATING COOKER WITH HINGED DOOR

(75) Inventors: Sung Kwang Kim, Ansan-si (KR); Dae Sung Han, Hwaseong-si (KR); Yong Hyun Kwon, Suwon-si (KR); Seok Weon Hong, Yongin-si (KR); Tae Uk Lee, Suwon-si (KR); Pung Yeun Cho, Suwon-si (KR); Han Seong Kang, Hwaseong-si (KR); Sung Soo Park, Hwaseong-si (KR); Han Jun Sung, Yongin-si (KR); Tae Hun Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1567 days.

(21) Appl. No.: 11/905,109

(22) Filed: Sep. 27, 2007

(65) Prior Publication Data

US 2008/0078373 A1 Apr. 3, 2008

(30) Foreign Application Priority Data

Sep. 28, 2006 (KR) ..... 10-2006-0094956

(51) Int. Cl.
*F23M 7/00* (2006.01)

(52) U.S. Cl.
USPC ..... 126/191; 126/192; 126/194; 126/273 R; 16/50; 16/60; 16/63; 16/80; 267/172; 267/173

(58) Field of Classification Search ..... 126/191, 126/192, 194, 197, 273 R–276; 267/170, 267/172, 173, 179; 16/49, 53, 60, 63, 64, 16/65, 50, 71, 78, 79, 80
See application file for complete search history.

(56) References Cited

U.S. PATENT DOCUMENTS

| | | | | |
|---|---|---|---|---|
| 3,865,097 | A * | 2/1975 | Robinson | 126/197 |
| 4,982,063 | A * | 1/1991 | Tsunekawa et al. | 219/723 |
| 5,291,634 | A * | 3/1994 | Zanetti | 16/333 |
| 5,293,020 | A * | 3/1994 | Han et al. | 219/724 |
| 5,726,427 | A * | 3/1998 | Hwang | 219/739 |
| 6,333,495 | B1 * | 12/2001 | Park | 219/722 |

(Continued)

FOREIGN PATENT DOCUMENTS

| | | |
|---|---|---|
| CN | 1172929 A | 2/1998 |
| CN | 2358364 Y | 1/2000 |

(Continued)

OTHER PUBLICATIONS

Chinese Office Action issued Mar. 13, 2009 in corresponding Chinese Patent Application 200710146989.7.

(Continued)

*Primary Examiner* — John K Fristoe, Jr.
*Assistant Examiner* — Jessica Cahill
(74) *Attorney, Agent, or Firm* — Staas & Halsey LLP

(57) ABSTRACT

Provided is a heating cooker which allows a door on a cooking chamber to be opened without direct handling of the door by a user. The heating cooker includes a body having a cooking chamber defined therein, a door hingably mounted to the body to open and close the cooking chamber, a door holder positioned in the body to hold the door and keep the cooking chamber closed by the door, and a hinge part connected between the door and the body to guide rotation of the door such that when the door is released from the door holder, the door is automatically opened.

19 Claims, 10 Drawing Sheets

U.S. PATENT DOCUMENTS

| | | | | |
|---|---|---|---|---|
| 6,453,510 | B1 * | 9/2002 | Cummins et al. | 16/343 |
| 2005/0193523 | A1 * | 9/2005 | Nam et al. | 16/330 |
| 2006/0162125 | A1 * | 7/2006 | Anzai | 16/303 |

FOREIGN PATENT DOCUMENTS

| | | | |
|---|---|---|---|
| CN | 1260464 | A | 7/2000 |
| KR | 20-1984-9466 | | 9/1984 |
| KR | 10-1992-0022425 | | 11/1992 |
| KR | 20-2005-0011522 | | 4/2005 |
| KR | 10-2005-0060560 | | 6/2005 |

OTHER PUBLICATIONS

Korean Office Action dated May 16, 2011, issued in Korean Patent Application No. 10-2006-0094956.

* cited by examiner

HEATING COOKER WITH HINGED DOOR

CROSS-REFERENCE TO RELATED APPLICATIONS

This application claims priority from Korean Patent Application No. 2006-0094956, filed on Sep. 28, 2006 in the Korean Intellectual Property Office, the disclosure of which is incorporated herein by reference.

BACKGROUND OF THE INVENTION

1. Field of the Invention

The present invention relates to a heating cooker, and, more particularly, to a heating cooker, which allows a door on a cooking chamber to be opened without requiring a user to directly pull the door, thereby improving convenience in use to the user.

2. Description of the Related Art

One example of a conventional heating cooker is disclosed in Korean Patent Application No. 2005-0060560, and includes a body having a cooking chamber defined therein, a door hingably mounted to the cooking chamber to open and close the cooking chamber, and a handle positioned on the door to be gripped by a user when opening and closing the door.

To open and close the opening of the cooking chamber at the front side thereof, the door has a lower end hingably coupled to a lower end of the body and an upper end having a front side provided with a bar-shaped handle with which the user can manually open and close the door.

For the conventional heating cooker described in Korean Patent Application No. 2005-0060560, since opening and closing of the door can be realized only by manual handling, there is an inconvenience in that, when opening the door with something held in the user's hand, it is necessary for the user to grip the handle and rotate the door downward. Thus, there is a need for a heating cooker which can overcome such an inconvenience.

SUMMARY OF THE INVENTION

Therefore, it is an aspect of the present invention to provide a heating cooker which allows a door to be opened in a one-touch manner without requiring a user to grip and rotate the door in an opening direction, thereby improving convenience in use by the user.

Additional aspects and/or advantages of the invention will be set forth in part in the description which follows and, in part, will be apparent from the description, or may be learned by practice of the invention.

The foregoing and/or other aspects of the present invention are achieved by providing a heating cooker including: a body having a cooking chamber defined therein; a door hingably mounted to the body to open and close the cooking chamber; at least one door holder positioned in the body to hold the door and keep the cooking chamber closed by the door; and a hinge part connected between the door and the body to guide rotation of the door such that when the door is released from the door holder, the door automatically opens.

The door holder may include a latch hook and a drive motor to move the latch hook, and the door may be formed with a latch groove to which the latch hook is latched.

The door holder may include an electromagnet to generate a magnetic force to cause the door holder to be brought into close contact with the door and an attachment member adjacent to the door, the electromagnet attracting the attachment member.

The door holder may include a button positioned on the door and movable up and down, a connecting bar connected to a rear side of the button, a supporting plate movably supporting the connecting bar, a return spring positioned between the supporting plate and the rear side of the button and receiving the connecting bar, and a latch hook connected to an end of the connecting bar, and wherein the body may include a latch part to which the latch hook is latched.

The body may include a control panel having an input button, and the door holder may be mounted at an upper end of the body to hold an upper end of the door and is connected to the control panel via a wire to be operated in response to an input signal from the input button.

The hinge part may include a bracket positioned at a lower end of the body and having a sloped surface formed thereon, a hinge case positioned in the door, at least one coupling shaft extending through the bracket and hinge case to rotatably connect the bracket and the hinge case, a slide member slidably positioned in the hinge case and having at least one slit formed therein to accommodate the at least one coupling shaft, a spring fixed at one end to the hinge case and at the other end to the slide member, and at least one roller positioned in the slide member so as to be brought into rolling contact, the sloped surface formed thereon to guide movement of the roller to allow automatic opening of the door via rotation.

The at least one coupling shaft includes a lower coupling shaft and the sloped surface formed on the bracket may have a length extending in a sloping direction with respect to the at least one coupling shaft.

The at least one coupling shaft includes an upper coupling shaft to prevent the sliding member from departing from the hinge case.

The heating cooker may further include a damper member positioned in the body and connected to the door to relieve shock when the door is opened.

The damper member may include a hollow damper housing, at least one damper spring positioned in the damper housing, at least one cam member received in the damper housing and abutted against one end of the damper spring, at least one cam shaft abutting against the cam member and provided at one end with a hinge shaft, and a cover housing to rotatably hold the at least one cam shaft.

The body may have a damper receiving section formed at a lower end of the door to accommodate the damper member, and the door may have at least one hinge shaft coupling part formed at the lower end of the door, to which the hinge shaft of the at least one cam shaft is coupled.

The foregoing and/or other aspects of the present invention are achieved by providing a heating cooker including: a body having a cooking chamber defined therein and a control panel including an input button; a door hingably mounted to the body to open and close the cooking chamber; a door holder holding the door to allow the door to close the cooking chamber and being connected to the control panel to allow the door to be automatically opened by releasing the door from the door holder in response to an input signal from the input button; and a hinge part connecting the door to the body to guide automatic opening of the door in response to a release signal of releasing the door from the door holder from the input button, the hinge part gradually reducing an opening speed of the door as an opening degree of the door is increased.

The door includes a latch groove formed on an upper end of the door and the door holder may include a latch hook latched to the latch groove and a drive motor to actuate the hook member.

The hinge part may include a bracket positioned at a lower end of the body and having a sloped surface formed thereon, a hinge case positioned in the door, at least one coupling shaft extending through the bracket and hinge case to hingably connect the bracket and the hinge case, a slide member slidably positioned in the hinge case and having at least one slit to accommodate the at least one coupling shaft, a spring fixed at one end to the hinge case and at the other end to the slide member, and at least one roller positioned in the slide member to be brought into rolling contact with the sloped surface formed thereon to guide movement of the roller to allow automatic opening of the door via rotation.

The at least one coupling shaft includes a lower coupling shaft and the sloped surface formed on the bracket may have a length extending in a sloping direction with respect to the at least one coupling shaft.

The at least one coupling shaft may include an upper coupling shaft to prevent the sliding member from departing from the hinge case.

The sloped surface of the bracket may include a first sloped surface formed on an upper surface of the bracket and the at least one roller may include a first roller brought into rolling contact with the first sloped surface of the bracket.

The sloped surface of the bracket may include a second sloped surface formed on a lower surface of the bracket and the at least one roller may include a second roller brought into rolling contact with the second sloped surface of the bracket.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
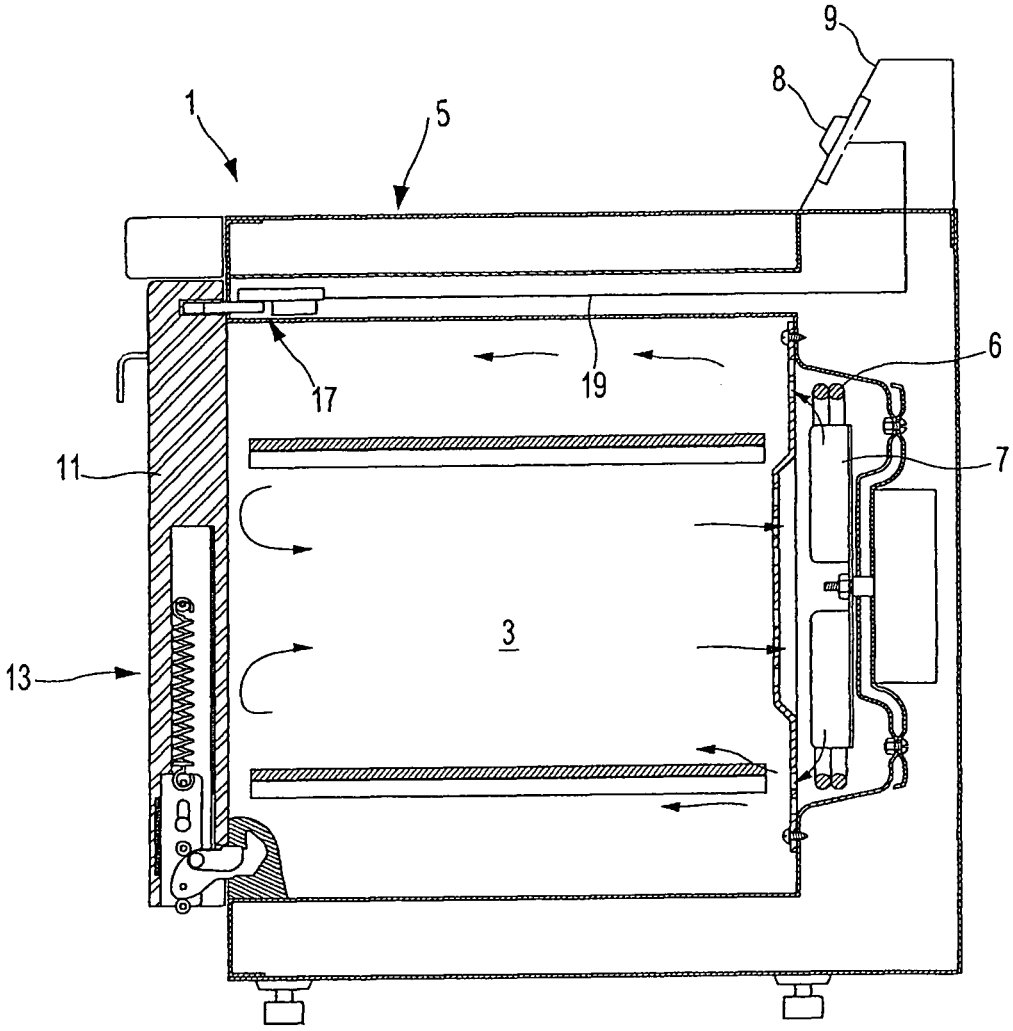
FIG. 1 is a side sectional view of a heating cooker according to an embodiment of the present invention.

Reference will now be made in detail to the embodiments of the present invention, examples of which are illustrated in the accompanying drawings, wherein like reference numerals refer to the like elements throughout the drawings. The embodiments are described below to explain the invention by referring to the figures.

Referring to FIG. 1, a heating cooker according to a first embodiment of the invention includes a body 1 constituting an appearance of the heating cooker and having a cooking chamber 3 defined therein, a heater 6 and a convection fan 7 positioned at a rear of the cooking chamber 3, and a burner 5 and a control panel 9 with an input button 8 and the like disposed thereon at an upper portion of the body 1.

The body 1 includes a door 11 rotatably mounted to a front side of the body 1 to open and close a front side of the cooking chamber 3, and a hinge part 13 positioned at a lower end of the door 11 to hingably connect the door 11 to the body 1 while allowing rotation of the door 11.

A door holder 17 is positioned between the cooking chamber 3 and the burner 5 and is coupled to the door 11 to hold the door 11 such that the door holder 17 can keep the cooking chamber 3 closed by the door 11 when the door 11 closes the cooking chamber 3. Here, the door holder 17 is connected to the control panel 9 via an electric wire 19 to be operated in response to an input signal from the input button 8.

Figure 2:
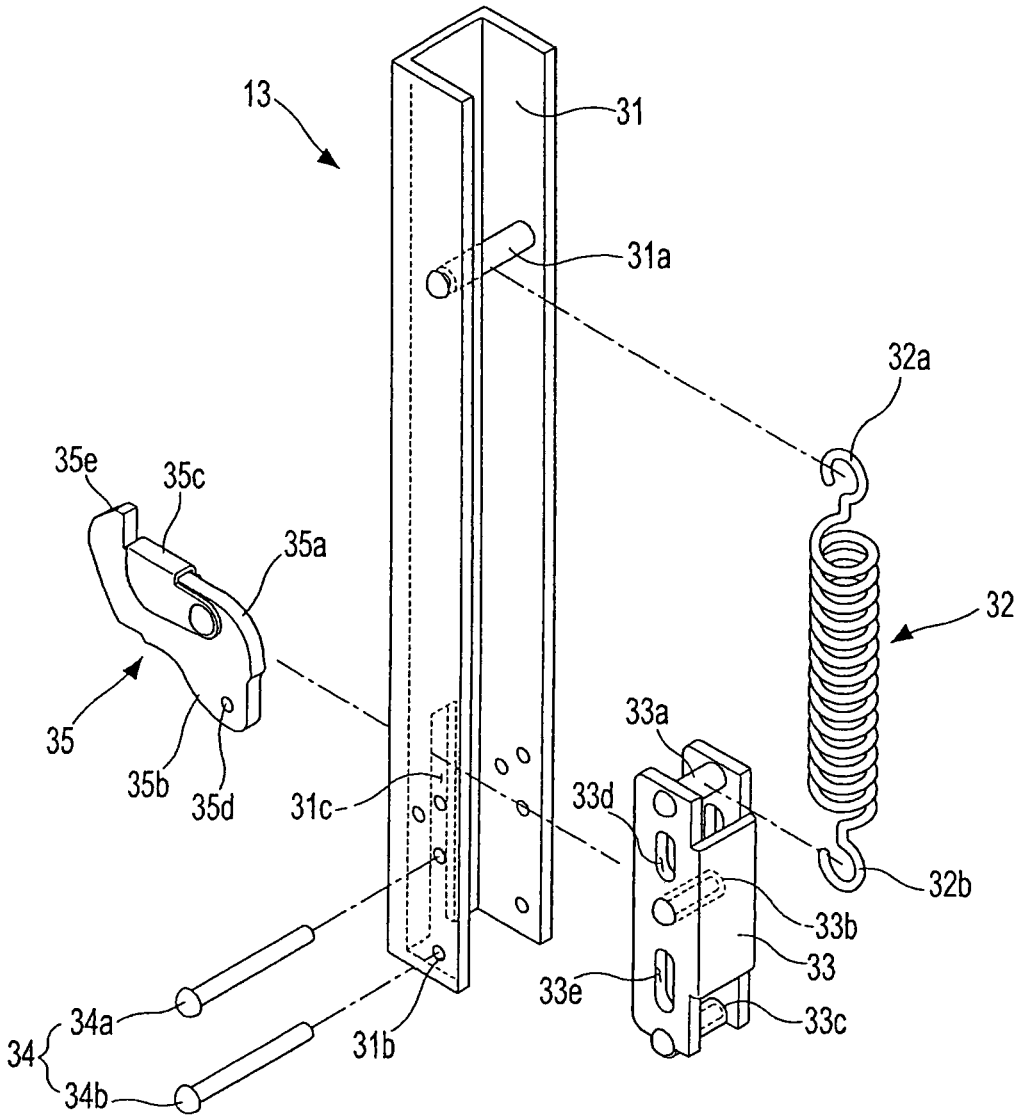
FIG. 2 is an exploded perspective view of a hinge part of the heating cooker according to a first embodiment of the present invention.

Details of the hinge part 13 will be described hereinafter with reference to FIG. 2. The hinge part 13 includes a hinge case 31 that constitutes an external appearance of the hinge part 13, a spring 32 having a shape of an tensile spring and being received in the hinge case 31, a first securing member 31*a* fixed in the hinge case 31 to hold one end of the spring 32, a slide member 33 positioned below the spring 32 to slidably move in the interior of the hinge case 31, and a bracket 35 connected to the slide member 33 and hinge case 31 to guide the movement of the slide member 33 while the slide member 33 abuts against the hinge case 31.

Here, the hinge case 31 is formed at a lower portion with an insertion part 31*c* into which the bracket 35 is inserted, and the spring 32 is respectively provided at upper and lower portions with first and second securing hooks 32*a* and 32*b*. The slide member 33 is provided at an upper portion with a second securing member 33*a*.

The first securing hook 32*a* is fixedly hooked to the first securing part 31*a* in the hinge case 31, and the second securing hook 32*b* is fixedly hooked to the second securing part 33*a* of the slide member 33.

The slide member 33 is formed at opposite sides with first and second slits 33*d* and 33*e* through which insertion shafts 34 extend to couple the slide member 33 to the hinge case 31.

The insertion shafts 34 include an upper coupling shaft 34*a* and a lower coupling shaft 34*b* inserted into the first and second slits 33*d* and 33*e*, respectively.

The slide member 33 is provided with a first roller 33*b* in a middle of the slide member 33 between the first slit 33*d* and the second slit 33*e* such that the first roller 33*b* is brought into rolling contact with a first sloped surface 35*a* formed on an upper part of the bracket 35.

The slide member 33 is provided at a lower portion with a second roller 33*c* that is brought into rolling contact with a second sloped surface 35*b* formed on the bracket 35. When the door 11 (see FIG. 1) is released from the door holder 17, the first and second rollers 33*b* and 33*c* are subjected to force in tangential directions with respect to the first and second sloped surfaces 35*a* and 35*b*, and move along the first and second sloped surfaces 35*a* and 35*b*, respectively.

In addition to the first and second sloped surfaces 35*a* and 35*b*, the bracket 35 has a supporting member 35*c* rotatably positioned on an upper surface of the bracket 35 to reinforce the bracket 35, and a latching jaw 35*e* formed at one end to allow the bracket 35 to be latched to the body 1 (see FIG. 1).

Furthermore, the bracket 35 is formed at a lower portion with a first through-hole 35*d* which corresponds to a second through hole 31*b* of the hinge case 31 and the second slit 33*e* of the slide member 33 such that the lower coupling shaft 34*b* extends through the first and second through-holes 35*d* and 31*b*, and then through the second slit 33*e* to connect the hinge case 31 and the slide member 33.

The upper coupling shaft 34*a* and the lower coupling shaft 34*b* serve to guide the slide member 33 to slidably move inside the hinge case 31, and to prevent the slide member 33 from being detached from the hinge case 31.

The lower coupling shaft 34*b* acts as an axis around which the slide member 33 and hinge case 31 rotate around the bracket 35.

Figure 3:
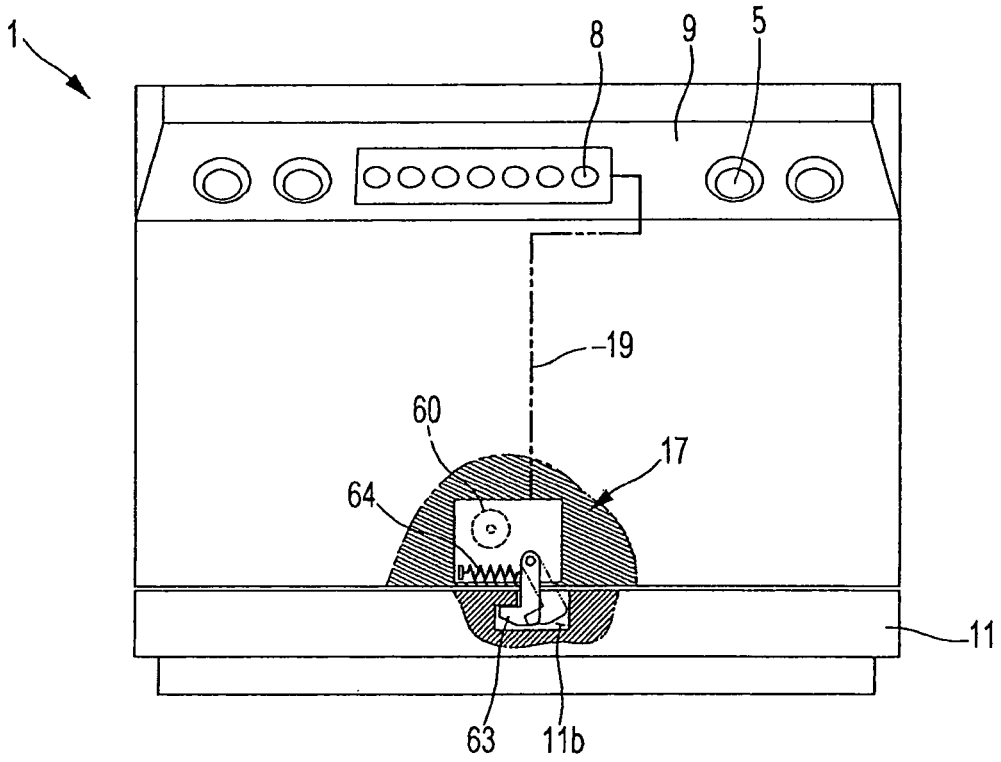
FIG. 3 is a plan view of the first embodiment of the present invention.

As can be seen from FIG. 3, the door holder 17 includes a driving motor 60 connected to the control panel 9 with the input button 8 disposed thereon, and a latch hook 63 actuated by the driving motor 60. The door 11 is formed with a latch groove 11*b* to which the latch hook 63 is latched and held.

The latch hook 63 is connected with a return spring 64 so that, when the force from the driving motor 60 is released after rotating the latch hook 63, the latch hook 63 is returned to its home location via restoration force of the return spring 64.

With this configuration, when the user operates the input button 8 to drive the driving motor 60 and release a latching state between the latch hook 63 and the latch groove 11*b*, the door 11 is automatically rotated and opened forwardly.

When the driving force of the driving motor 60 is released, the return spring 64 forces the latch hook 63 to return to its home location. When the user closes the door 11, an entrance of the latch groove 11*b* in the door 11 is caused to move along a slope on the front side of the latch hook 63, and the latch hook 63 is then latched to the latch groove 11*b*, thereby keeping the door 11 held closed by the door holder 17.

In this embodiment, the door holder 17 is illustrated as being positioned at the center of the body 1. However, those skilled in the art would understand that a plurality of door holders 17 may be disposed at both sides and/or either side of the body 1 to improve efficiency of closing and holding the door 1.

The input button 8 to operate the door holder 17 may be disposed at the front side of the body 1 adjacent the door 11 and is connected to the door holder 17 with the electric wire 19. The input button 8 may, however, be disposed at any point on the body 1 of the heating cooker, so long as the input button 8 is connected to the door holder 17 by a conductive wire.

Figure 4:
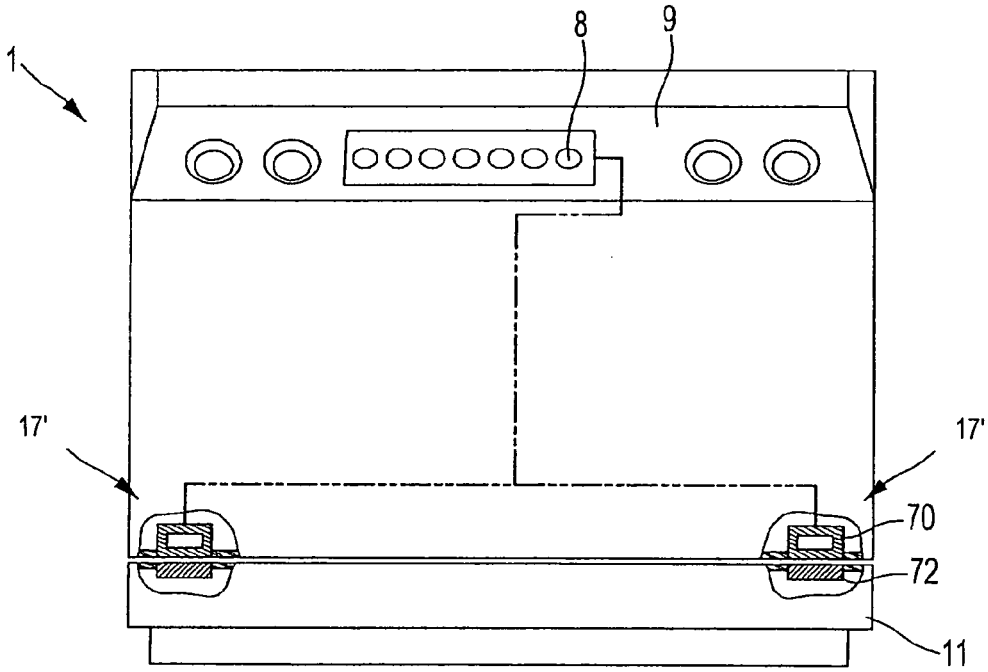
FIG. 4 is a plan view of a second embodiment of the present invention.

Referring to FIG. 4, a heating cooker according to a second embodiment of the present invention is shown, which includes a plurality of door holders 17' having a different structure from that of the first embodiment of the present invention. The cooker of the second embodiment includes an electromagnet 70 in place of the latch hook 63 of FIG. 3, and a metallic attachment member 72 adjacent the door 11 to be attached to the electromagnet 70.

In the second embodiment, the door 11 closes the cooking chamber 3 (see FIG. 1) by a magnetic force generated from the electromagnet 70 to attract the attachment member 72. Thus, when the magnetic force is removed from the electromagnet 70 by operation of the user, the door 11 is spontaneously rotated forwardly, opening the cooking chamber 3.

Figure 5:
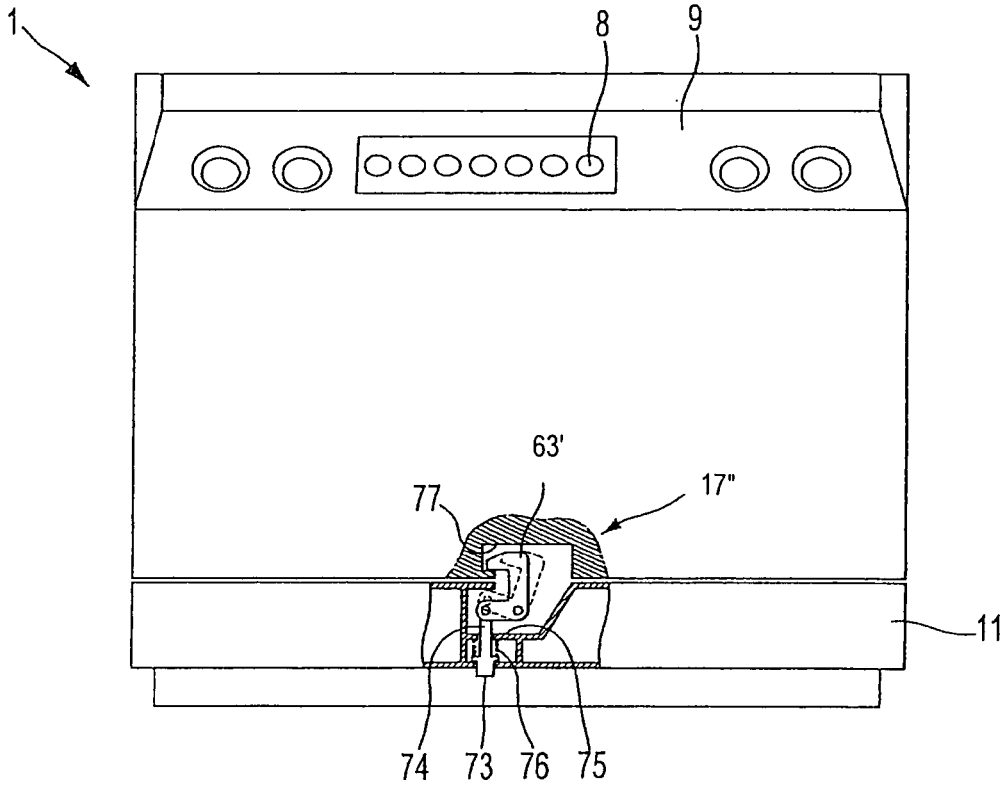
FIG. 5 is a plan view of a third embodiment of the present invention.

FIG. 5 shows a heating cooker according to a third embodiment of the present invention, which employs only mechanical components in place of the driving motor and the magnet.

The door 11 is provided with a stepped button 73, a connecting bar 74 connected to a rear of the button 73, a supporting plate 75 to support the connecting bar 74 while allowing the connecting bar 74 to move up and down, and a return spring 76 between the button 73 and the supporting plate 75 to allow the button 73 and the connecting bar 74 connected to the button 73 to return to their home positions when a force pushing the button 73 is removed.

The connecting bar 74 is provided at an end with a latch hook 63' which has a bent middle portion, around which the latch hook 63' is allowed to rotate in response to up and down movements of the connecting bar 74.

The body 1 of the heating cooker is provided at a front side with a latch groove 77 to which the latch hook 63' is latched, so that the door 11 closes or opens the cooking chamber 3 by latching or unlatching of the latch hook 63 to or from the latch groove 77.

Figure 6:
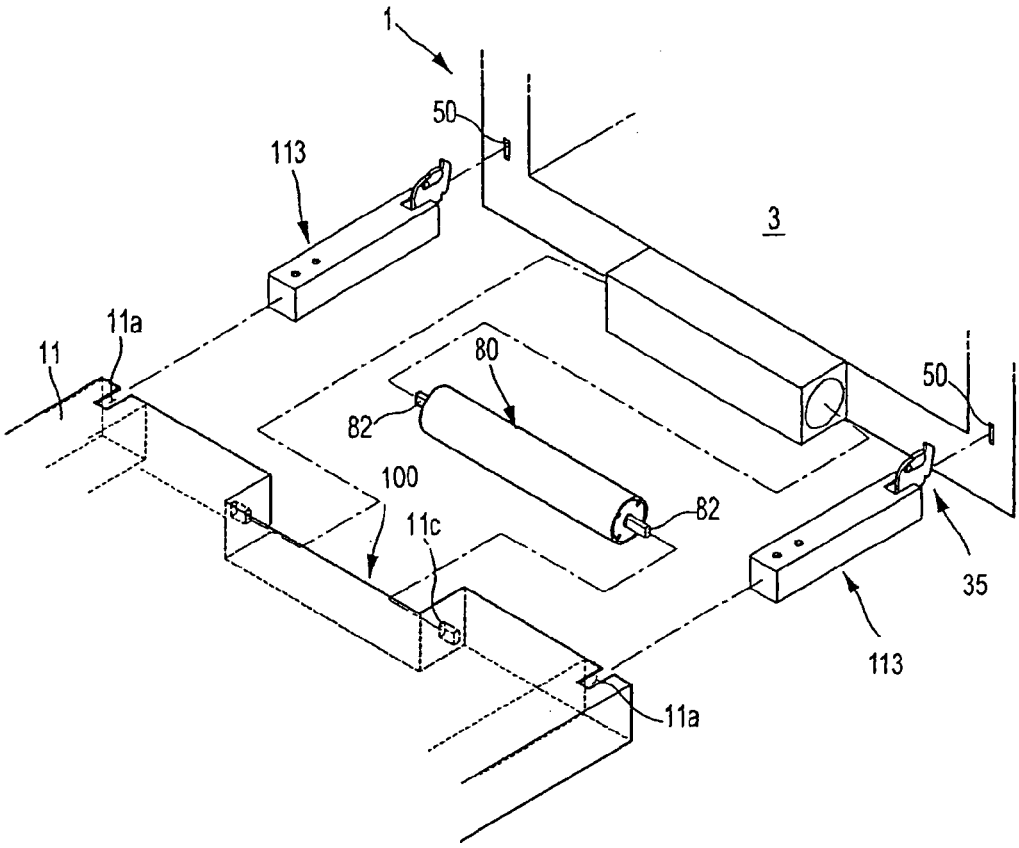
FIG. 6 is a perspective view of a fourth embodiment of the present invention.

FIG. 6 shows a heating cooker according to a fourth embodiment of the present invention, which includes the door holder 17, 17', 17", as shown in FIGS. 3 to 5, a typical hinge 113 positioned at either side of the door 11, and a damper member 80 positioned at the center of the door 11.

In this embodiment, since the hinge 113 has only a function of rotating without providing a damping function, there is a fear that the door 11 may be opened at a high speed toward a floor of a room, and may collide heavily against the floor, if a holding operation of the door holder 17, 17', 17" is released. Thus, in this embodiment, the damper member 80 is positioned at a lower middle of the door 11 to adjust an opening speed of the door 11.

Corresponding to the damper member 80, the body 1 is provided with a damper receiving section 100 to receive the damper member 80, and the door 11 is provided with hinge shaft coupling parts 11*c*, each of which engages with a cam shaft 82 rotatably extending through either side of the damper member 80 and having a hinge shaft. The hinges 113 are attached to the door 11 through hinge insertion portions 11*a*.

Further, each of the brackets 35 of the hinges 113 is inserted within bracket insertion holes 50 defined within sides of the body 1 of the heating cooker.

Figure 7:
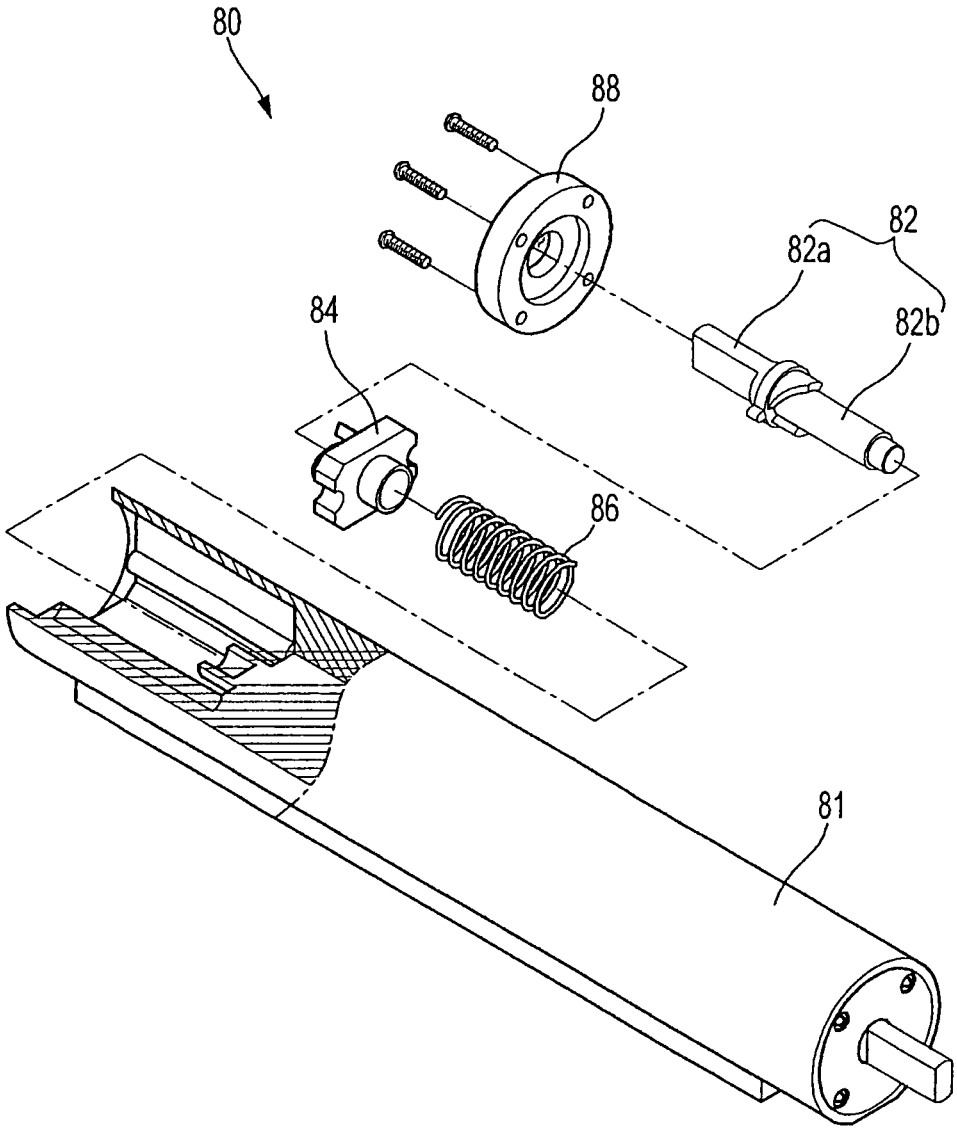
FIG. 7 is an exploded perspective view of a damper member of the third embodiment of the present invention.

Referring to FIG. 7, the damper member 80 includes a damper housing 81 constituting an external appearance of the damper member 80, cam shafts 82 each of which rotatably extend through a side of the damper member 80 and having a hinge shaft 82*a* at one end and a movable cam 82*b* at the other end, a cam member 84 abutted against the movable cam 82*b* of the cam shaft 82 to convert rotation of the cam shaft 82 into linear movement, a damper spring 86 abutted against the cam member 84 to relieve a moving speed of the cam shaft 84, and cover housings 88 disposed at each side of the damper housing 80 to rotatably hold the cam shaft 82.

Operation of the heating cooker according to the embodiments of the present invention will be described hereinafter with reference to the accompanying drawings.

Referring to FIG. 3, when the latch hook 63, shown more clearly in FIG. 3, is latched to the latch groove 11*b*, the door 11 is in a state of closing the cooking chamber 3.

When the door 11 closes the cooking chamber 3, the hinge part 13 stands upright, and the spring 32 is not stretched.

The first roller 33*b* rests on the first sloped surface 35*a* at the upper portion of the bracket 35, and the second roller 33*c* rests on the second sloped surface 35*b* thereof.

The upper coupling shaft 34*a* and the lower coupling shaft 34*b* are located at the lower end of the first and second slits 33*d* and 33*e*, respectively.

At this time, since the door holder 17 holds the door 11 with an upper portion of the door 11 secured to an upper portion of the body 1 to close the door, the first and second rollers 33*b* and 33*c* respectively resting on the first and second sloped surfaces 35*a* and 35*b* undergo a tangential force in a direction corresponding to an opening direction of the door 11, thereby keeping the door 11 closed against an attempt to open the door 11.

Figure 8:
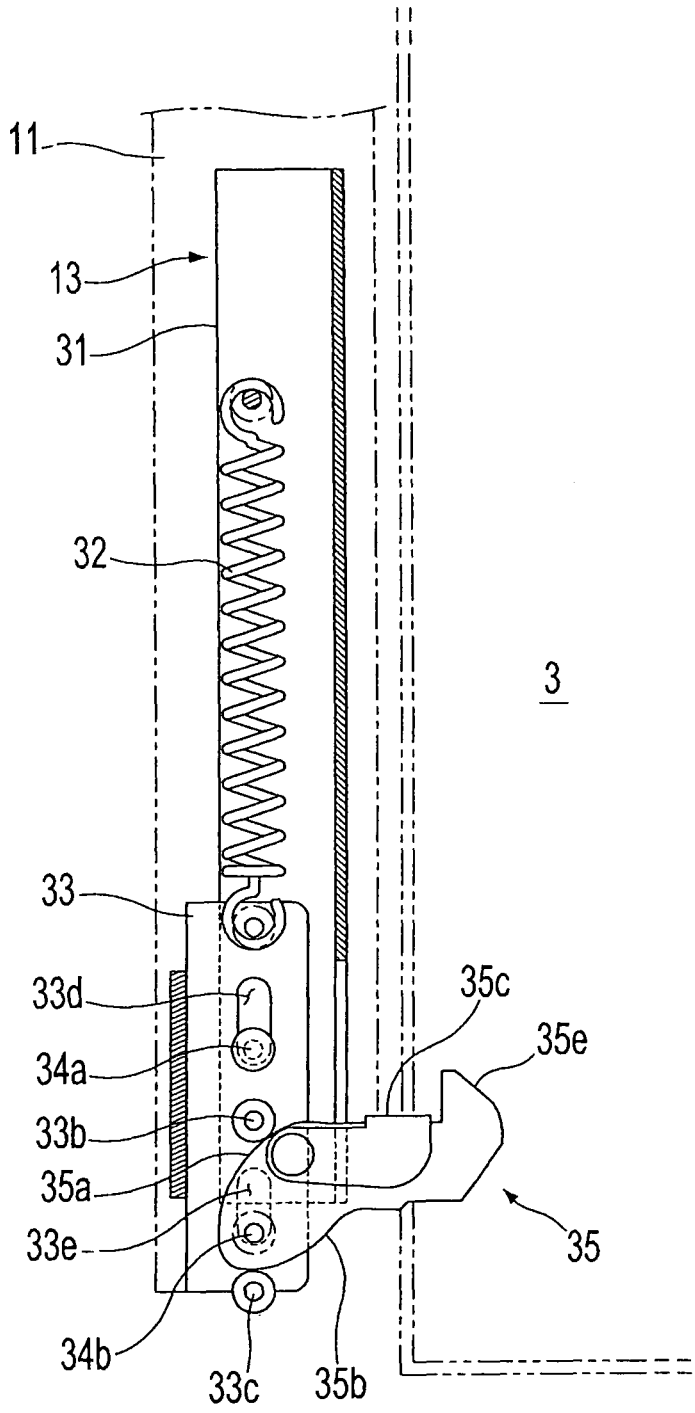
FIGS. 8 to 10 are partial side sectional views illustrating open and closed states of the door according to the embodiments of the present invention.

When the door holder 17 is released from the door 11, the upper end of the door 11 acts as a free end, as shown in FIG. 8, and among forces exerted between the first and second rollers 33*b* and 33*c* and the sloped surfaces 35*a* and 35*b*, the tangential force is applied in the direction of opening the door 11.

Thus, as the door 11 is slowly opened, the first roller 33*b* is moved along the first sloped surface 35*a*, and finally separated from the first sloped surface 35*a* after moving a predetermined distance.

The second roller 33*c* is also moved along the second sloped surface 35*b* corresponding to the movement of the first roller 33*b*.

Then, the slide member 33 moves downward to the lower portion of the door 11 where the upper coupling shaft 34*a* and the lower coupling shaft 34*b* approach the centers of the first and second slits 33*d* and 33*e*, respectively.

Due to such movement of the slide member 33, a distance between the first securing member 31*a* and the second securing member 33*a* is increased, causing extension of the spring 32. Then, the tensile force of the spring 32 acts as a kind of break against the door opening movement so that the door 11 is opened while slowly moving downward.

Figure 9:
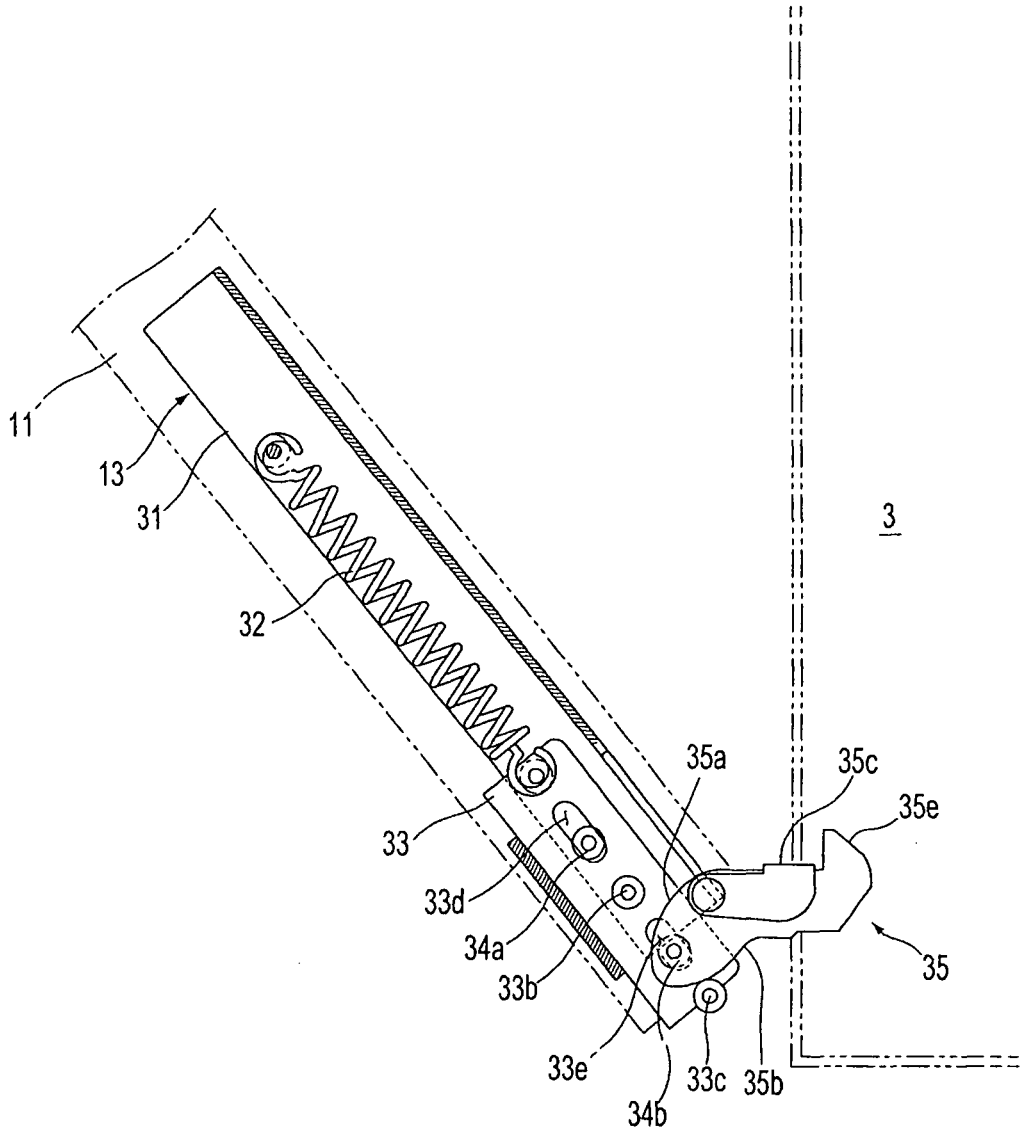
Figure 10:
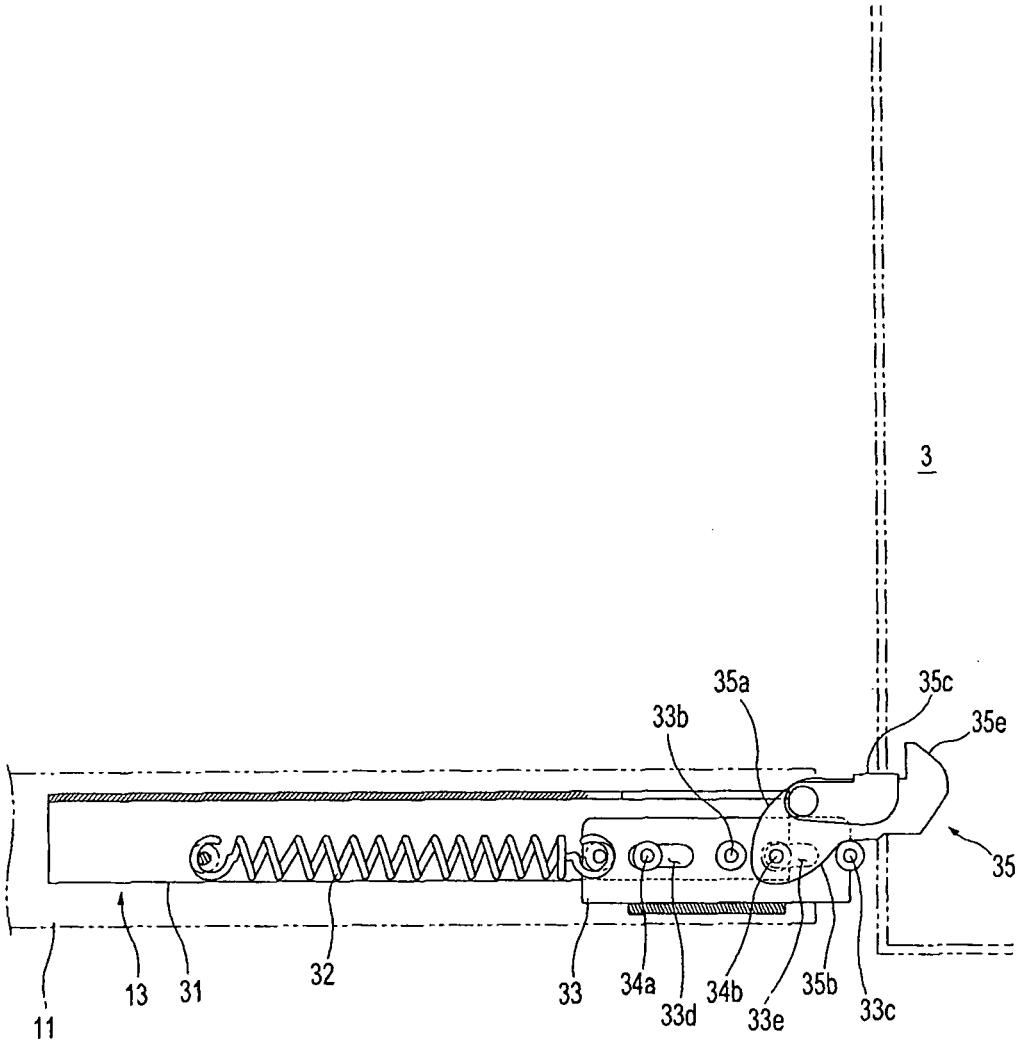

As shown in FIG. 9, when the door 11 is completely open, the first roller 33*b* is separated from the first sloped surface 35*a*, and the second roller 33*c* is disposed on the uppermost part of the second sloped surface 35*b*.

The slide member 33 is also moved in response to the change in position of the first and second rollers 33*b* and 33*c* such that the slide member 33 is further moved in a rightward direction, and the upper coupling shaft 34*a* and the lower coupling shaft 34*b* are located at left sides of the first and second slits 33*d* and 33*e*, respectively. With such movement of the slide member 33, the spring 32 is further extended.

On the other hand, when the user lifts the upper end of the door 11 as an action of closing the door 11, a distance between the first securing member 31*a* and the second securing member 33*a* is decreased by the restoration force of the spring 32, causing the slide member 33 to be gradually lifted within the hinge case 31.

Here, a closing speed of the door 11 and a lifting speed of the slide member 33 are increased by the restoration force of the spring 32.

At this time, the first roller 33*b* is lifted along the first sloped surface 35*a* after being brought into contact with the first sloped surface 35*a*, and the second roller 33*c* is lowered along the second sloped surface 35*b*.

Thereafter, when the door 11 is moved into a complete upright state, the door holder 17 holds the door 11, so the door 11 closes the cooking chamber 3.

As apparent from the above description, the heating cooker of the invention allows the door to be automatically opened as soon as a holding operation of the door holder is released in a one-touch manner, without directly pulling the door, to open the door, thereby improving convenience in use.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A heating cooker, comprising:

a body having a cooking chamber defined therein;

a door hingably mounted to the body to open and close the cooking chamber;

a door holder positioned in the body to hold the door and keep the cooking chamber closed by the door; and a hinge part connected between the door and the body to guide rotation of the door such that when the door is released from the door holder, the door automatically opens, wherein the hinge part comprises a bracket positioned at a lower end of the body and having a sloped surface formed thereon;

a hinge case positioned in the door;

at least one coupling shaft extending through the bracket and hinge case to rotatably connect the bracket and the hinge case;

a slide member slidably positioned in the hinge case and having at least one slit formed therein to accommodate the at least one coupling shaft;

a spring fixed at one end to the hinge case and at the other end to the slide member; and at least one roller positioned in the slide member so as to be brought into rolling contact with the sloped surface to guide movement of the roller to allow automatic opening of the door via rotation.

2. The heating cooker according to claim 1, wherein the door holder comprises:

a button positioned on the door and movable up and down, a connecting bar connected to a rear side of the button, a supporting plate movably supporting the connecting bar, a return spring positioned between the supporting plate and the rear side of the button and receiving the connecting bar, and a latch hook connected to an end of the connecting bar, wherein the body includes a latch part to which the latch hook is latched.

3. The heating cooker according to claim 1, wherein the at least one coupling shaft includes a lower coupling shaft and the sloped surface formed on the bracket has a length extending in a sloping direction with respect to the at least one coupling shaft.

4. The heating cooker according to claim 1, wherein the at least one coupling shaft includes an upper coupling shaft to prevent the slide member from departing from the hinge case.

5. The heating cooker according to claim 1, wherein the door holder comprises a latch hook and a drive motor to move the latch hook, and the door is formed with a latch groove to which the latch hook is latched.

6. The heating cooker according to claim 5, wherein the body includes a control panel having an input button, and the door holder is mounted at an upper end of the body to hold an upper end of the door and is connected to the control panel via a wire to be operated in response to an input signal from the input button.

7. The heating cooker according to claim 1, wherein the door holder comprises:

an electromagnet to generate a magnetic force to cause the door holder to be brought into close contact with the door, and an attachment member adjacent to the door, the electromagnet attracting the attachment member.

8. The heating cooker according to claim 7, wherein the body includes a control panel having an input button, and the door holder is mounted at an upper end of the body to hold an upper end of the door and is connected to the control panel via a wire to be operated in response to an input signal from the input button.

9. The heating cooker according to claim 1, wherein the sloped surface of the bracket includes a first sloped surface formed on an upper surface of the bracket and the at least one roller includes a first roller brought into rolling contact with the first sloped surface of the bracket.

10. The heating cooker according to claim 9, wherein the sloped surface of the bracket includes a second sloped surface formed on a lower surface of the bracket and the at least one roller includes a second roller brought into rolling contact with the second sloped surface of the bracket.

11. The heating cooker according to claim 1, further comprising:

a damper member positioned in the body and connected to the door to relieve shock when the door is opened.

12. The heating cooker according to claim 11, wherein the damper member comprises a hollow damper housing, at least one damper spring positioned in the damper housing, at least one cam member received in the damper housing and abutted against one end of the damper spring, at least one cam shaft abutting against the cam member and comprising a hinge shaft at one end, and a cover housing to rotatably hold the at least one cam shaft.

13. The heating cooker according to claim 12, wherein the body has a damper receiving section formed at a lower end of the door to accommodate the damper member, and the door has at least one hinge shaft coupling part formed at the lower end of the door, to which the hinge shaft of the at least one cam shaft is coupled.

14. A heating cooker, comprising:

a body having a cooking chamber defined therein and a control panel including an input button;

a door hingably mounted to the body to open and close the cooking chamber;

a door holder holding the door to allow the door to close the cooking chamber and being connected to the control panel to allow the door to be automatically opened by releasing the door from the door holder in response to an input signal from the input button; and a hinge part connecting the door to the body to guide automatic opening of the door in response to a release signal, from the input button, of releasing the door from the door holder, the hinge part gradually reducing an opening speed of the door as an opening degree of the door is increased, wherein the hinge part comprises a bracket positioned at a lower end of the body and having a sloped surface formed thereon;

a hinge case positioned in the door;

at least one coupling shaft extending through the bracket and hinge case to hingably connect the bracket and the hinge case;

a slide member slidably positioned in the hinge case and having at least one slit to accommodate the at least one coupling shaft;

a spring fixed at one end to the hinge case and at the other end to the slide member; and at least one roller positioned in the slide member to be brought into rolling contact with the sloped surface to guide movement of the roller to allow automatic opening of the door via rotation.

15. The heating cooker according to claim 14, wherein the door includes a latch groove formed on an upper end of the door and the door holder comprises a latch hook latched to the latch groove and a drive motor to actuate the hook member.

16. The heating cooker according to claim 14, wherein the at least one coupling shaft includes a lower coupling shaft and the sloped surface formed on the bracket has a length extending in a sloping direction with respect to the at least one coupling shaft.

17. The heating cooker according to claim 16, wherein the at least one coupling shaft includes an upper coupling shaft to prevent the slide member from departing from the hinge case.

18. The heating cooker according to claim 14, wherein the sloped surface of the bracket includes a first sloped surface formed on an upper surface of the bracket and the at least one roller includes a first roller brought into rolling contact with the first sloped surface of the bracket.

19. The heating cooker according to claim 18, wherein the sloped surface of the bracket includes a second sloped surface formed on a lower surface of the bracket and the at least one roller includes a second roller brought into rolling contact with the second sloped surface of the bracket.

* * * * *